United States Patent [19]

Gatton

[11] 4,249,233

[45] Feb. 3, 1981

[54] HAND HELD LIGHT HAVING BELT CARRYING CLIP AND BELT MOUNTING SHEATH THEREFOR

[76] Inventor: James W. Gatton, P.O. Box 27, Belleville, Ohio 44813

[21] Appl. No.: 19,778

[22] Filed: Mar. 12, 1979

[51] Int. Cl.[3] ..... F21L 15/08; F21V 21/08; F21V 33/00

[52] U.S. Cl. ..... 362/103; 362/109; 362/191; 362/396

[58] Field of Search ..... 362/103-109, 362/186, 190-191, 368, 370, 376, 396, 299-400, 253, 365-366, 371, 377, 202-206

[56] References Cited

U.S. PATENT DOCUMENTS

| | | | |
|---|---|---|---|
| 1,360,988 | 11/1920 | Potstada | 362/103 X |
| 1,416,153 | 5/1922 | Wright | 362/103 X |
| 2,235,109 | 3/1941 | Morey | 362/109 |
| 2,389,762 | 11/1945 | Burke | 362/191 X |
| 3,601,595 | 8/1971 | Kivela | 362/190 |

FOREIGN PATENT DOCUMENTS

| | | | |
|---|---|---|---|
| 177246 | 3/1922 | United Kingdom | 362/103 |

*Primary Examiner*—L. T. Hix
*Assistant Examiner*—Thomas H. Tarcza
*Attorney, Agent, or Firm*—Robert E. Stebens

[57] ABSTRACT

A hand-held light is provided having a belt carrying clip secured thereto to enable the ready removability of the light from a carrying position on a person's belt. The light includes a housing provided with an illumnable lamp having an exposed face from which light is emitted. Secured to the housing is a clip having an elongated, relatively narrow, belt-engaging portion that is formed from a structurally rigid material. The clip is rigidly secured at its one end to the housing and extends in superposed, overlying relationship to the face of the illuminable lamp. The belt engaging portion of the clip is positioned in relatively spaced relationship to the face of the lamp to admit the thickness of the carrying belt between the clip and the face of the lamp but is designed to frictionally interengage with said belt to retain the lamp in supported relationship.

A belt mounting sheath is also provided for utilization in cooperation with the light and its associated carrying clip for use alternatively in securing the light to a belt. The sheath includes a pocket for receiving the clip therein with the face of the lamp bearing against an outer surface of the sheath. The clip is formed with an enlarged marginal end portion overlying the lamp face which cooperatively interengages with the pocket of the sheath to reduce the likelihood of inadvertent removal of the lamp from the sheath.

10 Claims, 7 Drawing Figures

HAND HELD LIGHT HAVING BELT CARRYING CLIP AND BELT MOUNTING SHEATH THEREFOR

BACKGROUND OF THE INVENTION

This invention is directed to a portable hand-held electric light that is designed for use by hunters of small game animals as a specific instance of utilization. The particular function of such a light is to permit hunting at night for specific types of small game animals and, for that purpose, the lamp is advantageously associated with a portable, battery-type power supply. A power supply of this type may be conveniently carried in a belt that is worn by the hunter.

While the specific intended function of the illustrative embodiment of this invention is for purposes of hunting, it will be understood that the invention is not considered so limited in its application. There are many areas of usefulness wherein a person has need of an electrical lamp of a portable nature and which is carried by the person for intermittent utilization. This invention is particularly useful for such varied purposes and facilitates the carrying of a light for instant utilization in any particular situation.

SUMMARY OF THE INVENTION

The illustrative embodiment of this invention of a hand-held light with carrying clip includes a housing for the lamp and the electrically-energized, illuminable lamp assembly which is supported within the interior of the housing. A suitable light may comprise a rigid plastic housing of selected exterior configuration and may include a handle or other appendage for convenience in gripping and supporting of the lamp for directing the beam of light during its utilization. The illuminable lamp, as indicated, is of an electrical type having a relatively high candlepower output with power requirements such that it is necessary to connect the lamp to a separately contained power pack or battery-type power supply for ability to maintain operation over a prolonged period of time. A suitable electrical cable thus extends from the lamp housing and is provided with a connector or attaching means for forming the mechanical and electrical interconnection with an appropriate power source.

A specific type of power source that is particularly adapted for utilization with a lamp of this type is a belt carried power source havng a cable-connector socket incorporated therein. Such a belt-type power pack is worn by the person, such as a hunter, and may also provide the belt mounting for the hand-held light of this invention.

The belt mounting or carrying clip comprises an elongated, relatively narrow plate preferably formed from a strip of rigid metal and has one end thereof secured to the lamp housing. This elongated plate projects or extends in overlying relationship to a face of the lamp and is relatively spaced to that lamp surface to receive a suitable belt therebetween. In accordance with this invention, the clip extends over the face of the lamp to reduce the physical size of the unit that would otherwise be required of such a lamp and to also center the lamp at the point of attachment or carrying on a belt. This is a particularly advantageous feature in that this then substantially minimizes any interference of the lamp with adjacent portions of the body of the person who may be carrying the lamp assembly.

To further enhance the ability of the clip to retain the lamp in association with the belt, the clip is preferably provided with a uniquely shaped, free end portion that has an ability to interengage with the belt and prevent dislodgement of the lamp therefrom that may otherwise result from normally expected body movements. For this purpose, the free end portion includes a relatively enlarged section that is of a generally circular configuration, with smooth edges to prevent injury but which is capable of providing frictional interengagement with the surfaces of the adjacent portions of the belt. The frictional engagement of the clip, lamp face and housing with the belt, combined with the functional advantages of uniquely shaped clip end portion, results in a structure that has been found particularly capable of maintaining the light in proper carrying position on a belt that may be worn by a person.

Also, in accordance with this invention, a belt mounting sheath is provided for alternate utilization with the light and carrying clip combination to further enhance the carrying capabilities. This sheath is formed with a pocket for receiving the carrying clip with that pocket configured in such a manner that it will interengage with the clip and aid in preventing the inadvertent dislodgement of the lamp. The sheath may be provided with a detachable loop element for securing a cooperating handle element that may be provided with the light housing.

These and other objects of this invention, will be readily apparent from the following detailed description of an illustrative embodiment thereof and the accompanying drawings.

DESCRIPTION OF THE DRAWING FIGURES

DESCRIPTION OF THE ILLUSTRATIVE EMBODIMENT

Figure 1:
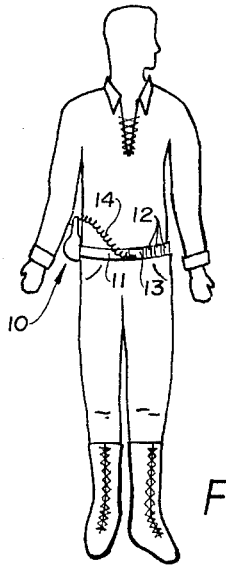
FIG. 1 is a diagrammatic illustration of a person wearing a belt mounted electrical power supply and on which a light assembly of this invention is supported.

Having reference to the drawings, particularly FIG. 1 thereof, it will be seen that a hand-held light and clip assembly embodying this invention, designated generally by the numeral 10, is shown in operative carrying relationship on a person's belt. This belt is illustrated in FIG. 1 as also being of the type which carries a portable, electrical battery-type power supply for this lamp. As such, the belt 11 includes a number of battery units 12 which are secured around the outer surface of the belt and are electrically interconnected to obtain the proper voltage. All of the battery units are interconnected with a control unit 13 which includes a connector socket for electrical connection with external circuits but the socket is not otherwise illustrated or described since its function in cooperation with this invention will be understood. The hand-held light is provided with a suitable electrical cable 14 having an end connector 15 for removably connecting the cable to the socket of the control unit 13.

It will be noted in FIG. 1 that the belt is worn by a person in a conventional manner at the waist and thus supports the light at a convenient elevation where it is out of interfering relationship with the wearer's legs or arms. This is an essential feature of this invention in that a hunter, a specifically intended user of such apparatus, must necessarily be physically active and thus location of the lamp at any other position would result in interference with body movements. It is for this reason that it is essential the light and its associated carrying clip be configured to maintain the light at a substantially centered position on the wearer's belt at the waist to prevent portions of the lamp, such as the handle or the power cable 14 from otherwise becoming entangled with the wearer or having portions of the rigid housing possibly inducing physical injury.

Figure 2:
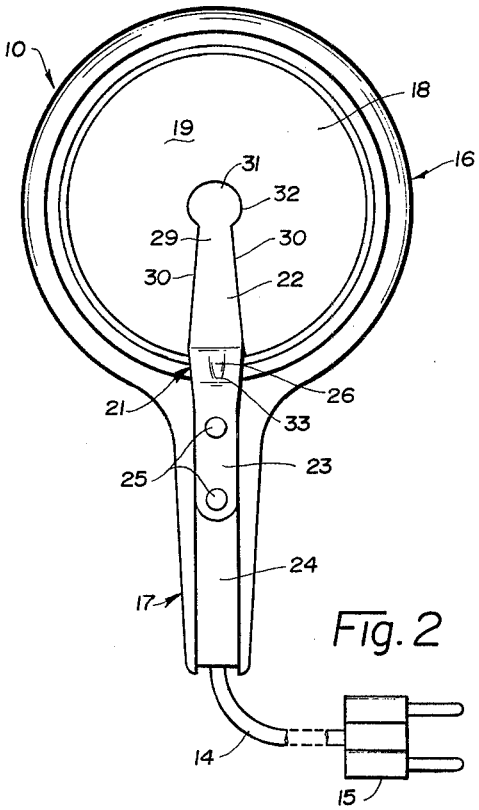
FIG. 2 is a front elevational view on an enlarged scale of an illustrative embodiment of the light assembly.
Figure 3:
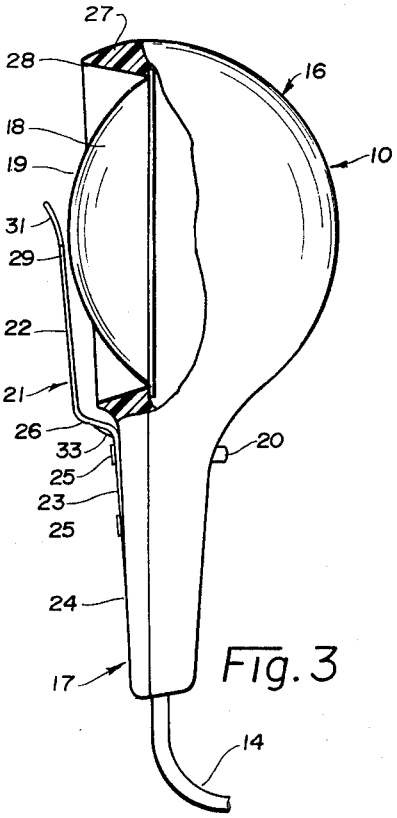
FIG. 3 is a side elevational view of the light with portions thereof broken away for clarity of illustration.
Figure 4:
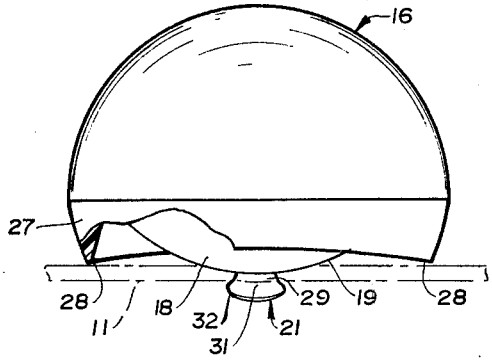
FIG. 4 is a top plan, partially sectioned view.

Specifics of the construction of an illustrative embodiment of the hand-held light and its associated carrying clip assembly are best seen in FIGS. 2, 3 and 4. These figures show a particular shape and construction of a hand-held light which is commercially available and includes a primary lamp housing 16 and a handle unit 17. The lamp housing 16 and handle unit 17 are conveniently formed from a suitable plastic material and comprise a generally integral construction of two sections to permit assembly of the internal components including that of the electrical lamp 18. The specifically illustrated lamp housing 16 is of a generally circular configuration in plan view with the rear of the housing being of a generally spherical shape and adapted to conform to the lamp 18 mounted therein. This lamp 18 is illustrated as being of a sealed beam type having a circular face formed with a slightly convex surface 19. Appropriate electrical interconnections are provided internally of the lamp housing 16 and include an actuating switch 20 which may be conveniently carried and mounted in the handle unit 17. As illustrated, this switch 20 is incorporated in the handle structure to project at the rearwardly facing portions of the light assembly where it may be readily actuated by a person's thumb. An electrical cable 14, as previously indicated, extends from the handle unit 17 for interconnection with the electrical power supply.

In accordance with this invention, a novel belt carrying clip 21 is provided to facilitate the securing and support of the light on a carrying belt which may either be a conventional apparel belt or the illustrated battery pack belt. This clip 21 is formed from a suitable metal, such as steel, having the desired structural rigidity and resilient characteristics to permit its functioning in securing of the light to the belt. Referring to FIGS. 2 and 3, it will be seen that this clip is a plate of relatively narrow, elongated configuration having a free-end portion 22 that projects in overlying relationship to the face 19 of the electrical lamp 18. Also incorporated in the clip structure is a mounting bracket section 23 which is longitudinally aligned with the free portion but is adapted for mechanical attachment to a front face 24 of the handle unit 17. Attachment can be effected by any suitable technique, although in the illustrated embodiment this is accomplished by utilization of two fastening devices 25 such as rivets or threaded bolt elements.

Referring to FIG. 2, it will be seen that the clip is configured with the free end portion 22 and mounting bracket section 23 disposed in co-planar but relatively offset relationship and connected by an intermediate section 26. Forming the free end portion 22 is a relatively narrow, elongated plate which is supported by the intermediate section 26 to extend in an inwardly directed relationship toward the surface 19 of the lamp. This configuration is designed to further assure that the clip will be capable of frictionally securing the assembly in engagement with the belt and this relationship of the clip in securing the belt and lamp is shown in the partially sectioned view of FIG. 4. It will be noted that the primary lamp housing 16 includes a circular peripheral rim 27 having a terminal edge 28 which results in the marginal edge portions of the lamp being relatively recessed from the terminal edge. However, the central portion of the lamp surface 19 projects a distance forwardly of the terminal edge 28 and is thus visible in a side elevational or horizontal sectional view such as those of FIGS. 3 and 4. To accommodate the width or thickness of the belt, it will be seen that the free end portion 22 of the clip has its terminal end 29 normally spaced a distance from the extreme forward surface 19 of the lamp with this spacing being designed to be slightly less than the thickness of a belt with which the lamp is to be utilized. Since most belts are of a standard thickness, the spacing can be selected for a typical thickness giving due consideraion to having an adequate tolerance. While the mounting bracket section 23 of the clip 21 is generally of substantially the same width throughout its entire length, it will be seen in FIG. 2 that the free end portion 22 has longitudinally extending edges 30 that are relatively convergent toward the terminal end 29. This relative convergence of the longitudinal edges reduces the width of the clip that projects over the face of the lamp 18. Such convergence is desirable to minimize the blocking effect that the clip could possibly produce as to the light that is emitted from the lamp 18. It has been found that with the specific dimensional configurations of such an illustrative embodiment, wherein the lamp has a diameter of approximately six inches, providing the clip 21 with a width at its widest portion as it extends over the lamp of the order of three quarters of an inch and diminishing to approximately one-half inch at its narrowest point, does not materially affect the light pattern that is transmitted. Since the light is effectively utilized only where there is a substantial distance involved, the effect is essentially unnoticeable through the diffusion of the light from the relatively uniformly divergent pattern obtained with the internal reflector of the lamp. In fact, lamps of this type are often provided with a center blocking area overlying the filament to effect the desired light distribution pattern for a concentrated and relatively narrow light beam.

Referring to FIG. 2 and also 4, it will be noted that the terminal end 29 of the clip 21 is provided with a relatively enlarged circular clamp plate 31. The clip 21 is designed so that the combined length of the free end portion 22 and the plate 31 will result in the plate being disposed at substantially the center of the lamp 18. The circular plate 31 is preferably provided to further enhance the ability of the clip to retain a lamp assembly in association with a belt. With the plate 31 having a larger circular diameter than the width of the adjacent portions of the portion 22, its peripheral edges 32, such as those closely adjacent the longitudinal edges 30, provide a relatively sharp change in the edge line which enables the device to more securely engage with the surfaces of a supporting belt. These surfaces and edges thus combine to maintain the clip in association with the belt even though it may be pivoted and subjected to extraneous forces that would otherwise tend to dislodge the lamp from its supported position as the sharp change in edge line forms a hook-like structure that tends to better engage with the belt surfaces.

Additional strength is provided for the clip through the formation of a reinforcing rib 33 at the juncture of the intermediate section 26 and the mounting bracket section 23. This reinforcing rib is of a V-shaped section integrally formed in the clip and extends across the angular juncture of these two components.

While a specific embodiment of the invention is shown as incorporated in a lamp assembly wherein the housing for the lamp is provided with a laterally projecting handle unit, it will be understood that the configuration of the lamp and its handle unit may be of other configurations. For example, the handle unit may be of a relatively compact configured arrangement with respect to the lamp housing and that the clip 21 would then be modified to have its mounting bracket section 23 to effectively interfit with and to be capable of attachment to the specific configuration of the lamp housing. Regardless of the specifiic configuration of the mounting bracket section 23 of a clip, such as whether it is as illustrated in exposed relatonship to the exterior of the housing or is incorporated into the interior of the lamp housing, the specific configuration will not effect the scope and concepts of the invention as disclosed herein. An important one of these concepts is the providing of a clip in association with the lamp housing such that it includes a free end portion extending in overlying relationship to the surface of a lamp. It is the combination of the clip extending over the surface of the lamp which enables the lamp to be secured and carried on a belt in reliably secure relationship while minimizing and maintaining a minimal dimensional configuration.

A suitable belt mounting sheath is also provided in accordance with this invention for utilization with the lamp and clip assembly 10 as described and illustrated specifically in FIGS. 2, 3 and 4. While this sheath which is designated generally by the numeral 35 is designed for use with the illustrated lamp assembly, it will also be understood that the particular configuration of the lamp and its handle arrangement may be varied as previously described. Regardless of such variations in the specific formation of the clip mounting, it will be seen that the sheath is usable in a very convenient manner with a lamp that is provided with the illustrated clip which extends in overlying relationship to the lamp surface. Specifically, the sheath 35 comprises a strip 36 of flexible material, such as leather, which is folded upon itself into a U-shape having the upper ends substantially aligned as indicated. Also included in the sheath construction is an elongated, flat strip 37 of similar flexible material which projects longitudinally into the interior space of the U-shaped portion 36 extending substantially to the bottom thereof and is secured thereto in fixed relationship. Referring to the front and side elevational views FIGS. 5 and 6, it will be seen that the securing of the U-shaped portion 36 and the elongated strip 37 is effected by fastening devices 38 such as rivets which project through the upper ends of the U-shaped portion 36. This attachment by the fastening devices 38 results in the formation of a closed loop through which the belt may extend with the belt being shown in broken lines and disposed between the rear section of the U-shaped portion 36 and the strip 37.

Also preferably provided in this combination is a handle securing strap 39 which is attached to the extreme upper end portion of the elongated strip 37. The relative length of the strip 37 and the positioning of the securing strip 39 is determined by the particular configuration of the lamp and its associated handle unit 17. The loop itself is best provided with free ends that are detachably secured to each other by appropriate snap-type fastening devices 40 when the strap is placed around the handle 17 of the lamp housing 16 as is diagramatically illustrated in FIG. 6.

Figure 5:
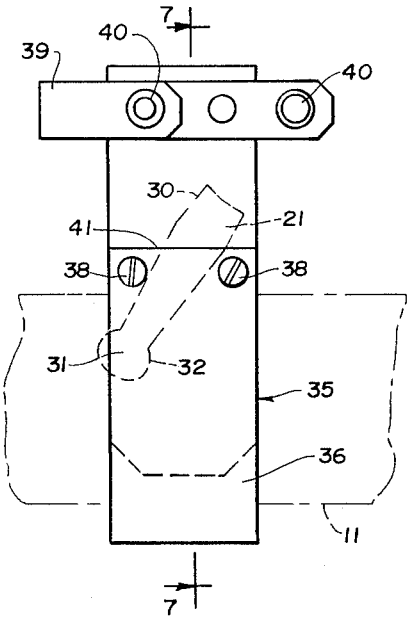
FIG. 5 is a front elevational view of a belt mounting sheath for the lamp and clip assembly.
Figure 6:
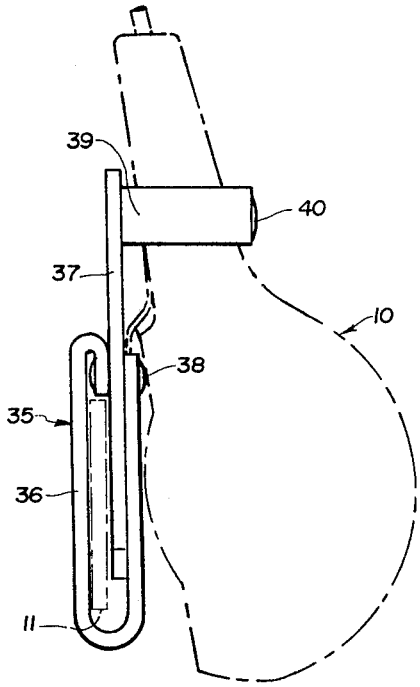
FIG. 6 is a left side elevational view of the sheath.
Figure 7:
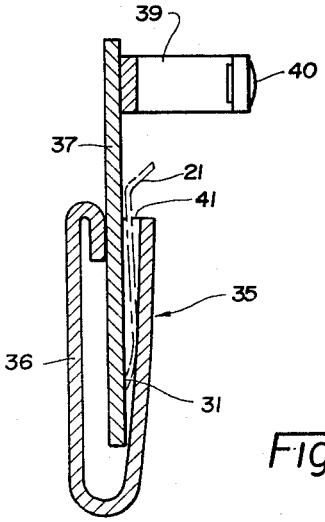
FIG. 7 is a vertical medial sectional view taken along line 7—7 of FIG. 5.

Functioning of the belt mounting sheath 35 can be best seen by reference to FIG. 5. It will be noted in that figure that the width or spacing as between the fastening devices 38, results in a predetermined width or opening 41 defined by the strip 37 and front section of the U-shaped portion that is designed to closely approximate the width or diameter of the circular plate 31 of the clip 21. Thus, the clip may be inserted through the opening 41 formed between the front portion of the U-shaped section 36 and the underlying elongated strip 37 to project into the interior space between those two components. When thus inserted, it will be seen that the circular plate 31 is disposed within the space although in contacting engagement with the associated surfaces of the strip 37 and the U-shaped portion 36. With the securing loop 39 disengaged or either not provided, it will be seen that a lamp which may be inadvertently pivoted at the general location of the opening to this pocket, will be effectively prevented from being removed as a consequence of interference between the peripheral edges 32 of the circular plate 31 and the compressed and clamped adjacent surfaces of the U-shaped portion 36 and strip 37. This is indicated in broken lines in a general manner in FIG. 5 where the clip 21 is shown pivoted to a relatively displaced position and thus will be seen to prevent the inadvertent removal of the lamp. The adjacent hook-forming edges 30 and 32 tend to engage with the sheath at the fastener 38 to prevent complete withdrawal of the clip. Removal is only readily accomplished by vertically centering the clip and its associated lamp with respect to the sheath and then vertically withdrawing the clip from the sheath.

It will be readily apparent from the foregoing description of an illustrative embodiment of this invention that a particularly novel hand-held light with belt carrying clip is provided. The light and clip are designed and configured to provide a reliably secure attachment of the light in a convenient position on a person's belt where it will present minimal interference to normal body movements and will thus be least affected by such body movements that would otherwise dislodge the light from a belt carrying position. A novel belt mounting sheath is also provided to further enhance the secured carrying of the light on a belt.

Having thus described this invention, what is claimed is:

1. A hand-held light having a belt carrying clip comprising an electrical lamp assembly including a housing and an electrical lamp supported in said housing in fixed relationship thereto, said electrical lamp having a surface of predetermined configuration from which light can be emitted, and a carrying clip mounted on said housing and formed from a relatively rigid material and including a free end portion of plate-like configuration which extends over the lamp surface to a predetermined distance in superposed relationship to said lamp surface for gripping of a belt therebetween in frictionally clamped relationship.

2. A hand-held light according to caim 1 wherein said free end portion is elongated and of relatively narrow width in proportion to said lamp surface to effectively avoid interference with a beam of light emanating from said lamp.

3. A hand-held light according to claim 2 wherein said free end portion is a thin plate having longitudinally extending opposite edges relatively converging toward an outer terminal end thereof and which free end portion is provided with a clamp plate of relatively enlarged width dimension having a peripheral edge that intersects each of the convergent longitudinally extending edges in angular relationship to form a hook-like configuration.

4. A hand-held light according to claim 3 wherein said clamp plate is formed with said free end portion at an angle to the plane thereof in outwardly directed relationship to said lamp surface.

5. A hand-held light according to claim 3 wherein said clamp plate is of circular configuration having the peripheral edge thereof intersecting each of the convergent longitudinally extending edges in obtuse angular relationship.

6. A hand-held light according to claim 1 wherein said lamp assembly includes a handle unit mechanically coupled with said housing and projecting laterally outward with respect thereto in generally parallel relationship to the surface of said electrical lamp, and said carrying clip including a mounting bracket section extending in superposed relationship to said handle unit and rigidly secured thereto.

7. A hand-held light according to claim 1 including in combination therewith a belt mounting sheath, said sheath including a loop for removable attachment with a belt and a pocket for cooperative interengaging reception of said carrying clip.

8. A hand-held light and sheath according to the combination of claim 7 wherein said sheath pocket includes an entrance opening thereto of predetermined width and said carrying clip free end portion is an elongated thin plate having longitudinally extending opposite edges relatively converging toward an outer terminal end thereof and which free end portion is provided with a clamp plate of relatively enlarged width dimension having a peripheral edge that intersects each of the convergent longitudinally extending edges in angular relationship to form a hook-like configuration, said clamp plate being capable of projection through said sheath opening and interlocking engagement therewith.

9. A hand-held light and sheath according to the combination of claim 8 wherein said sheath has a pair of superposed sheet form elements defining said sheath pocket and which are rigidly secured together at a point at each side of said entrance opening whereby the hook-like configuration of said carrying clip will cooperatively interengage with said sheath at either point of securing of the sheet-form elements.

10. A hand-held light and sheath according to the combination of claim 8 wherein said lamp assembly includes a handle unit mechanically coupled with said housing and projecting laterally outward therefrom in generally parallel relationship to said carrying clip, said sheath including handle securing means selectively interengageable with said handle unit when said carrying clip is inserted in said sheath pocket.

* * * * *